US006413704B1

(12) United States Patent
Szajewski et al.

(10) Patent No.: US 6,413,704 B1
(45) Date of Patent: Jul. 2, 2002

(54) IMAGE FORMING ASSEMBLY AND METHOD USING A LAMINATION APPARATUS

(75) Inventors: Richard P. Szajewski, Rochester; Wanda K. Swartz, Albion, both of NY (US)

(73) Assignee: Eastman Kodak Company, Rochester, NY (US)

( * ) Notice: Subject to any disclaimer, the term of this patent is extended or adjusted under 35 U.S.C. 154(b) by 43 days.

(21) Appl. No.: 09/592,818

(22) Filed: Jun. 13, 2000

(51) Int. Cl.[7] ..... G03C 1/72
(52) U.S. Cl. ..... 430/496
(58) Field of Search ..... 428/343; 430/496

(56) References Cited

U.S. PATENT DOCUMENTS

| | | | | | |
|---|---|---|---|---|---|
| 3,640,204 | A | | 2/1972 | Gordon | 118/235 |
| 4,211,558 | A | * | 7/1980 | Oguchi et al. | 430/359 |
| 4,313,667 | A | | 2/1982 | Gold | 354/303 |
| 4,561,745 | A | | 12/1985 | Kinsman et al. | 354/299 |
| 4,770,972 | A | * | 9/1988 | Nelson et al. | 430/404 |
| 5,701,541 | A | | 12/1997 | Ueda et al. | 396/569 |
| 5,756,269 | A | | 5/1998 | Ishikawa et al. | 430/351 |
| 5,758,223 | A | | 5/1998 | Kobayashi et al. | 396/604 |
| 5,832,328 | A | | 11/1998 | Ueda | 396/572 |
| 5,965,332 | A | | 10/1999 | Kikuchi | 430/351 |
| 5,988,896 | A | | 11/1999 | Edgar | 396/604 |
| 6,001,544 | A | | 12/1999 | Makuta et al. | 430/405 |
| 6,017,684 | A | | 1/2000 | Miyake | 430/351 |
| 6,022,673 | A | | 2/2000 | Ishikawa | 430/351 |
| 6,048,110 | A | | 4/2000 | Szajewski et al. | 396/575 |
| 6,218,093 | B1 | * | 4/2001 | Thomas | 430/493 |

FOREIGN PATENT DOCUMENTS

| | | |
|---|---|---|
| DE | 116 864 | 2/1900 |
| WO | 98/40787 | 3/1998 |
| WO | 98/40788 | 3/1998 |

OTHER PUBLICATIONS

USSN 09/592,816 filed Jun. 13, 2000, titled An Image Processing and Manipulation System by Richard P. Szajewski, Allan F. Sowinski and John D. Buhr (81040).

USSN 09/592,243 filed Jun. 13, 2000, titled An Image Rprocessing Apparatus and Method for Thermally Processed Films by James H. Reynolds, David H. Levy and Mark E. Irving (81076).

USSN 09/592,880 filed Jun. 13, 2000, titled Processing Apparatus and Method for Determining Optimum Processing Conditions by David H. Levy, Mark E. Irving and James H. Reynolds (81084).

USSN 09/592,922 filed Jun. 13, 2000, titled A Thermal Film Having at Least Two Imaging Layers with Different Processing Characteristics and a Method of Forming and Processing the Same by Gary L. House and David H. Levy (81093).

(List continued on next page.)

*Primary Examiner*—Hoa Van Le
(74) *Attorney, Agent, or Firm*—David A. Novais

(57) ABSTRACT

An image forming assembly and method utilizes a laminate processing sheet. The laminate processing sheet is applied on an emulsion side of an exposed photosensitive film which includes s rocket holes along opposing edges. In a first feature of the present invention, a width of the laminate processing sheet is confined to an image area between the opposing sprocket holes, so as to reduce or eliminate the possibility of processing marks in or around an area of the opposing sprocket holes. In a further feature of the present invention, an absorbing sheet can be applied to the backside of the photosensitive film, to absorb any excess processing or wetting solution that is applied to the photosensitive film. This also aids in reducing or eliminating unwanted processing marks at the sprocket holes or an area in the vicinity of the sprocket holes.

4 Claims, 7 Drawing Sheets

OTHER PUBLICATIONS

USSN 09/ 09/592,836 filed Jun. 13, 2000, titled A Thermal Processing System and Method Including a Kiosk by David H. Levy, Richard P. Szajewski, Mark E. Irving, Lyn M. Irving (81094).

USSN 09/592,814 filed Jun. 13, 2000, titled A Thermal Processor and Method Adapted to Process a Film Containing a Resistive Heating Element, and a Film Containing Such an Element by David H. Levy (81095).

* cited by examiner

IMAGE FORMING ASSEMBLY AND METHOD USING A LAMINATION APPARATUS

FIELD OF THE INVENTION

The present invention relates to an improved image forming assembly and method using a lamination apparatus. More specifically, the present invention relates an image forming assembly and method using a lamination apparatus for camera formatted films which reduces or eliminates processing marks.

BACKGROUND OF THE INVENTION

The lamination development of imagewise exposed silver halide films is well known. Specific examples of lamination processing include instant photography as originally popularized by the Polaroid Corporation and a somewhat related print making process commercialized as Pictography by Fuji Photofilm Company. The processes all include the addition of moisture and the application of a laminate sheet to an imagwise exposed element silver halide element. Chemical ingredients necessary for photo processing can be delivered as solution components in the applied moisture or they can be delivered in the applied laminate sheet. Photo processing occurs in an apparently dry manner when the laminate sheet is then intimately contacted to the light sensitive material.

More recently, attempts have been made to extend this processing scheme to camera formatted silver halide films. Several specific examples are disclosed by Ishikawa et al. in U.S. Pat. No. 5,756,269, by Ishikawa in U.S. Pat. 6,022.673, by Kikuchi in U.S. Pat. No. 5,965,332, by Miyake in U.S. Pat. No. 6,017,684 and by Irving et al. in pending application Ser. No. 09/475,510, filed Dec. 30, 1999. This art discloses the application of moisture to either the sensitized photographic material or to the laminate processing sheet followed by the lamination of the laminate processing sheet to the sensitized good so as to effect photo-processing.

In a related art, laminate sheets pre-wetted with conventional photo-processing are disclosed by Clough in WO 98/40787 and WO 98/40788. These disclosures describe the application of developing agents, bleaching agents, fixing agents and clearing agents to imagewise exposed films.

The camera-formatted films described in these recent references differ from the sheet films used in instant photography and in Pictography in that the camera formatted films include sprocket holes to enable the film to be controllably advanced in a camera. FIG. 1A shows an imagewise exposed camera film 101 bearing a latent image and having sprocket holes 105 and a processing laminate sheet 103. FIG. 1B shows a side view, through line a—a of FIG. 1A of the same components with an indication of application of moisture according to arrow 102 to the emulsion face of light sensitive film 101. On contacting moistened film 101 to processing laminate sheet 103 photo processing occurs. It has been observed that a processed image 107 as illustrated in FIG. 1C regularly has processing marks 109 emanating from sprocket holes 105. This is at least due to the fact that processing laminate sheet 103 extends over sprocket holes 105 in a width wise direction. Processing marks 109 associated with sprocket holes 105 are unique to camera formatted films and negatively impact the visually pleasing character of images that consumers desire and have come to expect.

SUMMARY OF THE INVENTION

The present invention provides for an image forming assembly and method which utilizes a laminate processing sheet. The method and apparatus of the present invention uses a unique laminate sheet that reduces or eliminates processing marks on photosensitive film having sprocket holes.

The present invention provides for an image forming assembly that comprises a laminate processing sheet that is adapted to be laminated on an emulsion side of an exposed photosensitive film. The laminate processing sheet comprises a processing component or solution for processing the photosensitive film. In one embodiment, the photosensitive film has first sprocket holes that extend longitudinally along a first side edge of the photosensitive film and second sprocket holes that extend longitudinally along a second side edge of the photosensitive film. A first widthwise distance on the photosensitive film is defined between the first sprocket holes and the second sprocket holes. The laminate processing sheet defines a second widthwise distance which is smaller than the first widthwise distance so as not to extend over the first and the second sprocket holes when the laminate processing sheet is laminated over the photosensitive film.

The present invention also provides for an image forming assembly which comprises a laminate processing sheet adapted to be laminated on an emulsion side of an exposed photosensitive film, with the laminate processing sheet comprising processing solution for processing the photosensitive film, and the photosensitive film having opposing longitudinally extending sprocket holes; and an absorbing sheet applied on a support side of the photosensitive film which is opposite the emulsion side, with the absorbing sheet absorbing excess processing solution from the opposing sprocket holes and an area in a vicinity of the opposing sprocket holes.

The present invention also provides for an image forming method which comprises the step of applying a laminate processing sheet onto an emulsion side of an exposed photosensitive film having opposing longitudinally extending sprockets holes. The laminate processing sheet comprises processing solution and the laminate processing sheet is applied in an area between the opposing sprocket holes so as not to extend over the sprocket holes.

The present invention also provides for an image forming method which comprises the steps of: applying a laminate processing sheet onto an emulsion side of an exposed photosensitive film having opposing longitudinally extending sprocket holes, with the laminate processing sheet comprising processing solution for processing of the photosensitive film; and applying an absorbing sheet onto a support side of the photosensitive film which is opposite the emulsion side, with the absorbing sheet absorbing excess processing solution from the opposing sprocket holes and an area in a vicinity of the opposing sprocket holes.

The present invention also provides for an image forming assembly which comprises a processing sheet adapted to be applied on an emulsion side of an exposed photosensitive film, with the processing sheet comprising processing solution for processing the photosensitive film. The photosensitive film comprises opposing sprocket holes and the processing sheet is applied on an area of the photosensitive film which is between the opposing sprocket holes.

In another embodiment, the photosensitive film has sprocket holes that extend longitudinally along a first side edge of the photosensitive film only. A first widthwise distance on the photosensitive film is defined between the sprocket holes and the second side edge of the photosensitive film. The laminate processing sheet defines a second widthwise distance which is smaller than the first widthwise distance so as not to extend over the sprocket holes when the laminate processing sheet is laminated over the photosensitive film.

The present invention also provides for an image forming method which comprises the steps of applying a processing sheet on an emulsion side of an exposed photosensitive film having longitudinally extending sprocket holes, with the laminate processing sheet comprising processing solution for processing of the photosensitive film; and applying a sumping member to a support side of the photosensitive film which is opposite the emulsion side, with the sumping member removing processing solution from the sprocket holes and an area in a vicinity of the sprocket holes.

The present invention also provides for an image forming assembly which comprises a processing sheet adapted to be applied onto an emulsion side of an exposed photosensitive film having longitudinally extending sprocket holes, with the laminate processing sheet comprising processing solution for processing of the photosensitive film; and a sumping member adapted to be applied onto a support side of the photosensitive film which is opposite the emulsion side, with the sumping member being adapted to remove processing solution from the sprocket holes and an area in a vicinity of the sprocket holes.

DETAILED DESCRIPTION OF THE INVENTION

Figure 2:
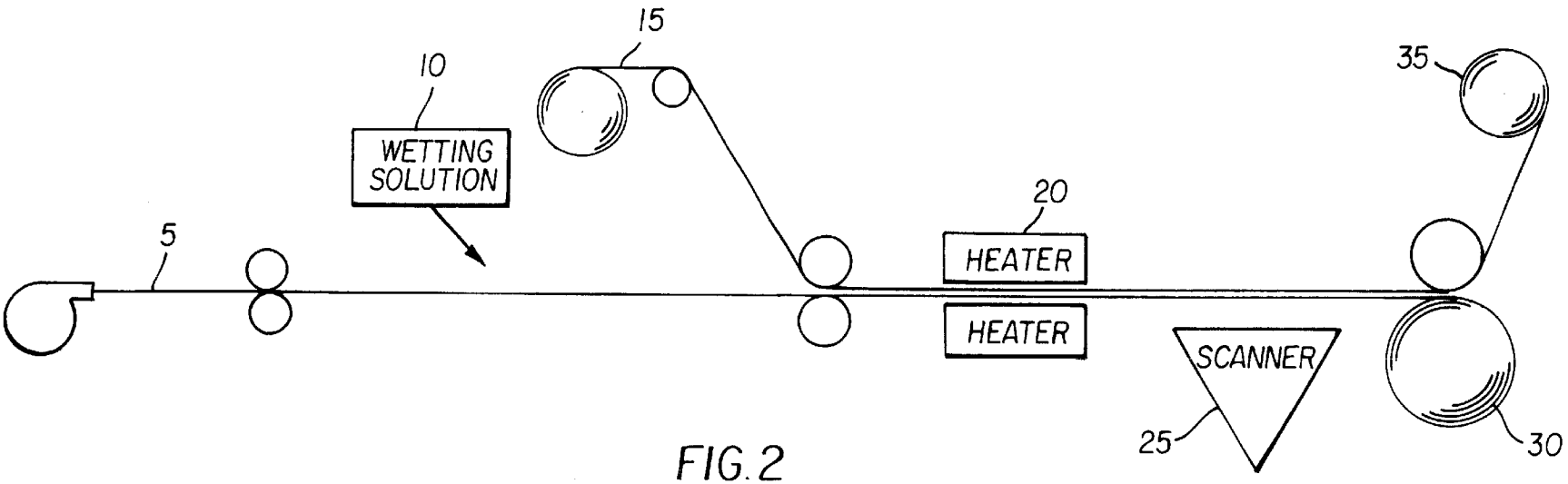
FIG. 2 is an example of an apparatus for conveying photosensitive film.

Referring now to the drawings, wherein like reference numerals represent identical or corresponding parts throughout the several views, FIG. 2 illustrates a basic example of a development or processing system in accordance with the present invention. As illustrated in FIG. 2, exposed photosensitive film 5 which can be thermal film as disclosed in U.S. Pat. No. 6,048,110, is thrust in a known manner from, for example, a thrust cartridge as also illustrated in U.S. Pat. No. 6,048,110. The film is conveyed along a development path and under a wetting solution applicator 10 which moistens the exposed photosensitive film.

Typical wetting solutions include water and basic solutions. Useful methods and volumes are well known in the art and are specifically disclosed in the earlier cited references. In one preferred embodiment the wetting device is a head with multiple nozzles and the applied solution is a basic solution as disclosed by Makuta et al., U.S. Pat. No. 6,001,544. In another preferred embodiment, the wetting device is a dip tank and the applied solution is water as disclosed by Ishikawa et al., U.S. Pat. No. 5,756,269. In yet another preferred embodiment the wetting device is a dip tank and the applied solution is a basic activator solution as disclosed by Irving et al., U.S. Ser. No. 09/475,510 filed Dec. 30,1999. In yet another embodiment, the applied solution is a developing solution and the applicator is a thermal jet head as described by Edgar, U.S. Pat. No. 5,988,896. In yet another embodiment, the laminate is wetted by dipping or by nozzle instead of the imagewise exposed photosensitive element. Additional methods of applying limited quantities of solution to light sensitive elements or laminate sheets through jetting orifices are disclosed by Ueda, U.S. Pat. No. 5,832,328, Ueda et al, U.S. Pat. No. 5,701,541, Kobayashi et al, U.S. Pat. No. 5,758,223.

A laminate 15 (which can be in roll form or separate sheets) is applied to a surface of photosensitive film 5, and the film with the applied laminate thereon is conveyed passed a heater 20 for developing images on the film. Processing laminate sheet 15 includes a processing component or processing solution which is activated while passing through the heater 20 for developing images on the film. Downstream of heater 20, film 5 can be scanned by scanner 25 and taken up by take-up roller 30. Additionally, the spent laminate sheet 5 can also be taken up via take-up roller 35 and recycled. Again, FIG. 2 illustrates one example of a developing system which can be used in the present invention and other systems are possible.

Figure 1A:
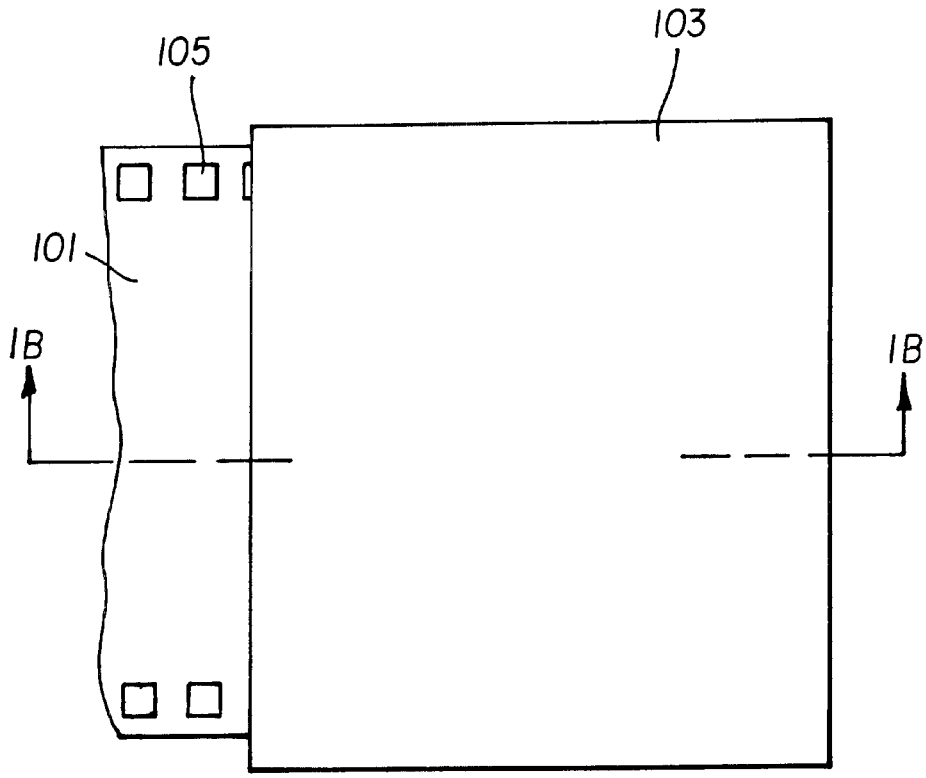
FIG. 1A shows an imagewise exposed camera formatted film and a processing laminate sheet.
Figure 1B:
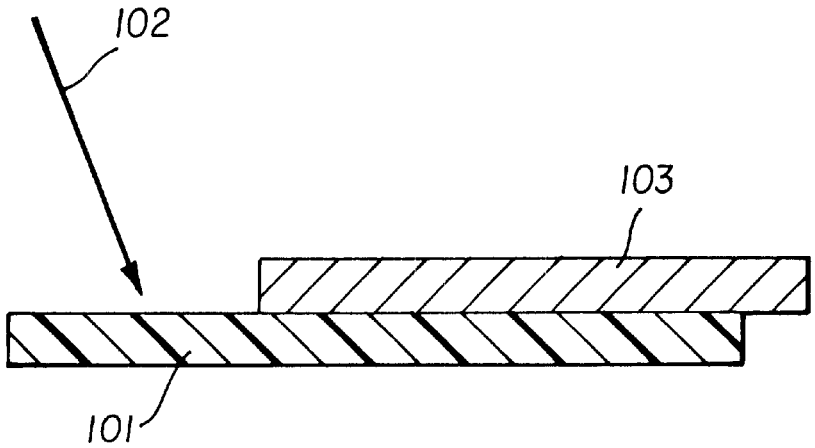
FIG. 1B is a side view of the film and processing laminate sheet illustrated in FIG. 1A.
Figure 1C:
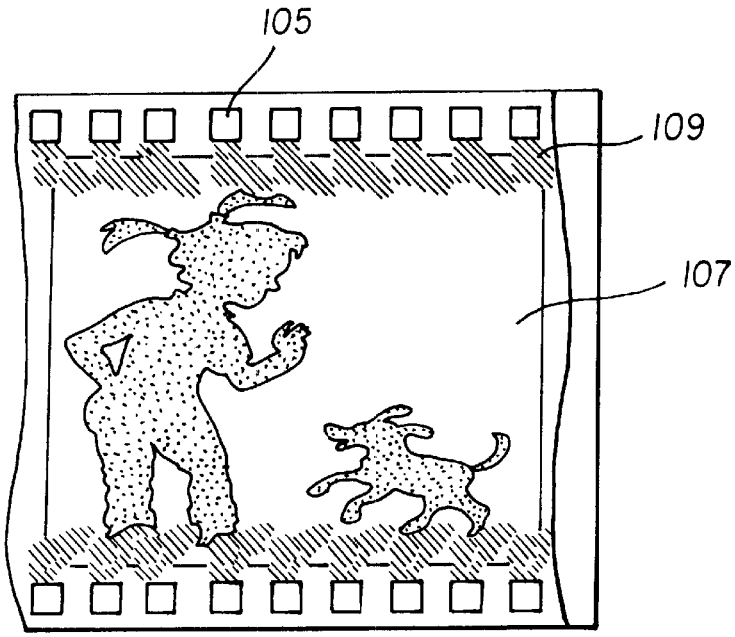
FIG. 1C illustrates an image processed in accordance with the arrangement of FIGS. 1A and 2B.

When processing exposed photosensitive film having sprocket holes, the processing generally leaves distracting processing marks in the area of the image which corresponds to the sprocket holes as described above and shown in FIG. 1C.

Figure 3A:
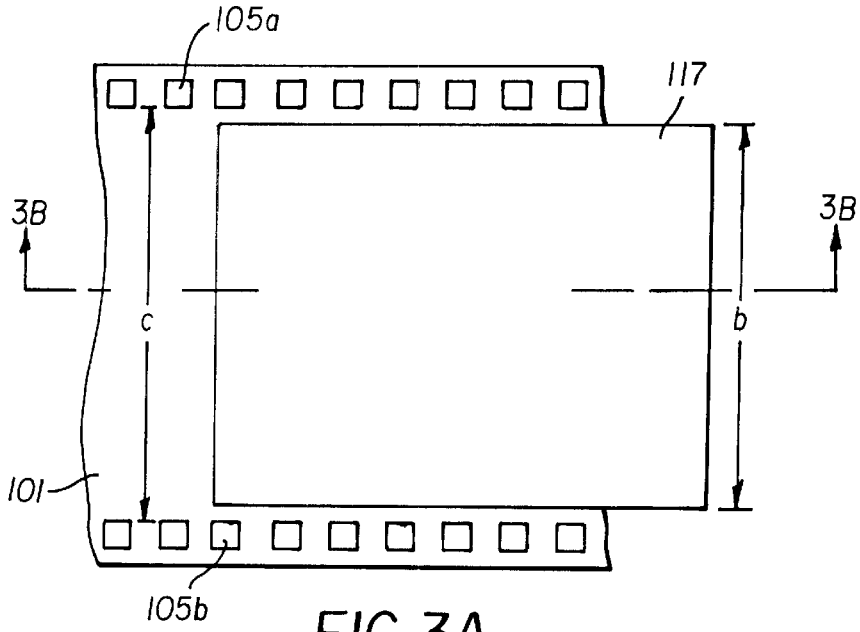
FIG. 3A illustrates an imagewise exposed photosensitive film and an applied laminate processing sheet in accordance with one embodiment of the present invention.

FIG. 3A illustrates a first embodiment of the present invention which addresses the unwanted processing marks by limiting the width of the processing laminate sheet to an image area of a camera formatted film having sprocket holes. More specifically, FIG. 3A shows an image-wise exposed camera formatted film 101 having first sprocket holes 105*a*, second sprocket holes 105*b* and an applied laminate processing sheet 117. In a first feature of the present invention, a width "b" of laminate processing sheet 117 is limited to the area between sprocket holes 105*a*, 105*b*. That is, as illustrated in FIG. 3A sprocket holes 105*a* and 105*b* extend longitudinally along opposing side edges of photosensitive film 101. A width-wise distance "c" is defined on film 101 between sprocket holes 105*a* and 105*b*. Distance "b" of laminate processing sheet 117 is smaller than the distance "c" so as to confine laminate processing sheet 117 within an image area between sprocket holes 105*a*, 105*b*.

Figure 3B:
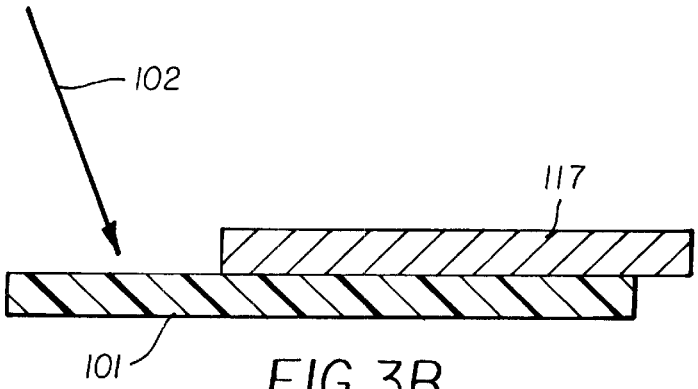
FIG. 3B is a side view of the photosensitive film and laminate sheet of FIG. 3A.

FIG. 3B is a side view through line a—a of FIG. 3A. FIG. 3B illustrates the application of moisture to an emulsion face of film 101 in a direction shown by arrow 102 and the intimate contact of laminate processing sheet 117 of limited width to the emulsion face of camera film 101. As described with reference to FIG. 2, the solution can be a wetting solution which is applied via wetting solution applicator 10.

Figure 5:
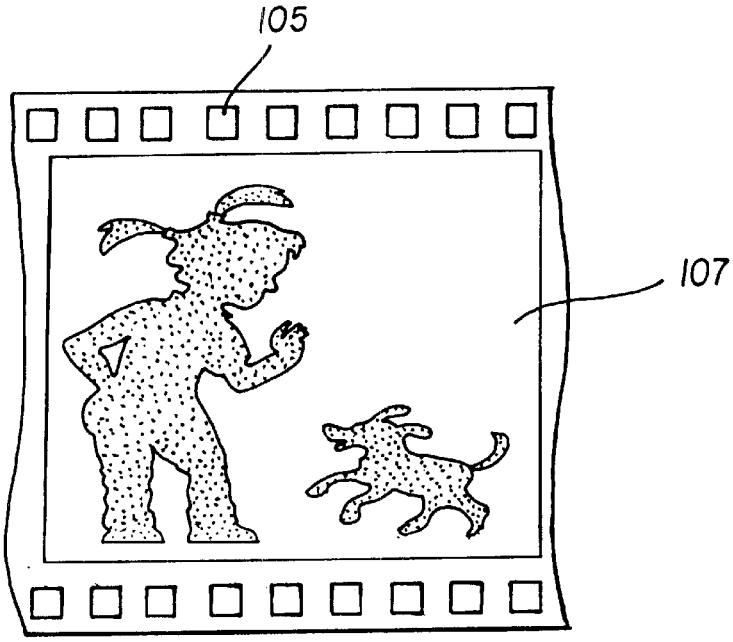
FIG. 5 illustrates a resulting image processed in accordance with the arrangements shown in FIGS. 3A and 4A.

With the arrangement as illustrated in Figs.3A and 3B, images as shown in FIG. 5 can be obtained. That is, by confining the width of laminate processing sheet 117 to an image area between sprocket holes 105*a* and 105*b*, unwanted processing marks at sprocket holes 105*a*, 105*b*, and in an area in the vicinity of sprocket holes 150*a*and 105*b* are reduced or eliminated, so as to provide for the clear image illustrated in FIG. 5.

Further, with the arrangement illustrated in FIGS. 3A and 3B, the apparatus for applying processing laminates as illustrated in FIG. 2 can be modified to accept the narrower processing laminate sheets, and to constrain the processing laminate sheets to contacting the film in a central area by adjusting (narrowing) laminate transport guides which guide the laminate sheet onto the photosensitive film.

Figure 3C:
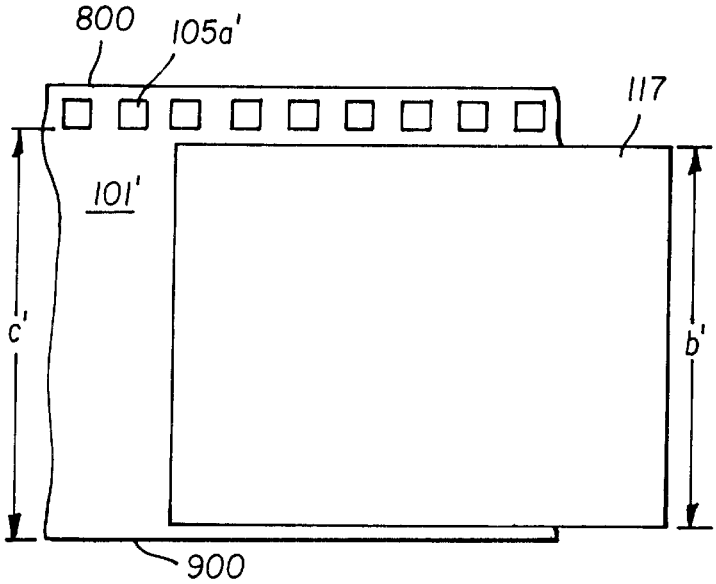
FIG. 3C illustrates a further example of an exposed film and an applied laminate processing sheet.

Of course, the present invention is not limited to film having sprocket holes that extend along both sides of the film. As illustrated in FIG. 3C, in a further feature of the invention, a film 101' can include sprocket holes 150*a'* that extend longitudinally along only one side 800 of film 101. A first widthwise distance c' on film 101' is defined between sprocket holes 105*a'* and a second side edge 900 of film 101'. Laminate processing sheet 117 defines a second widthwise distance b' which is smaller than first widthwise distance c' so as not to extend over sprocket holes 150*a* when laminate processing sheet 117 is laminated over film 101'. The results of the arrangement of FIG. 3C would be the same of FIG. 3A with respect to eliminating processing marks at sprocket holes 105*a'* and in the area in the vicinity of sprocket holes 105*a'*.

Figure 4A:
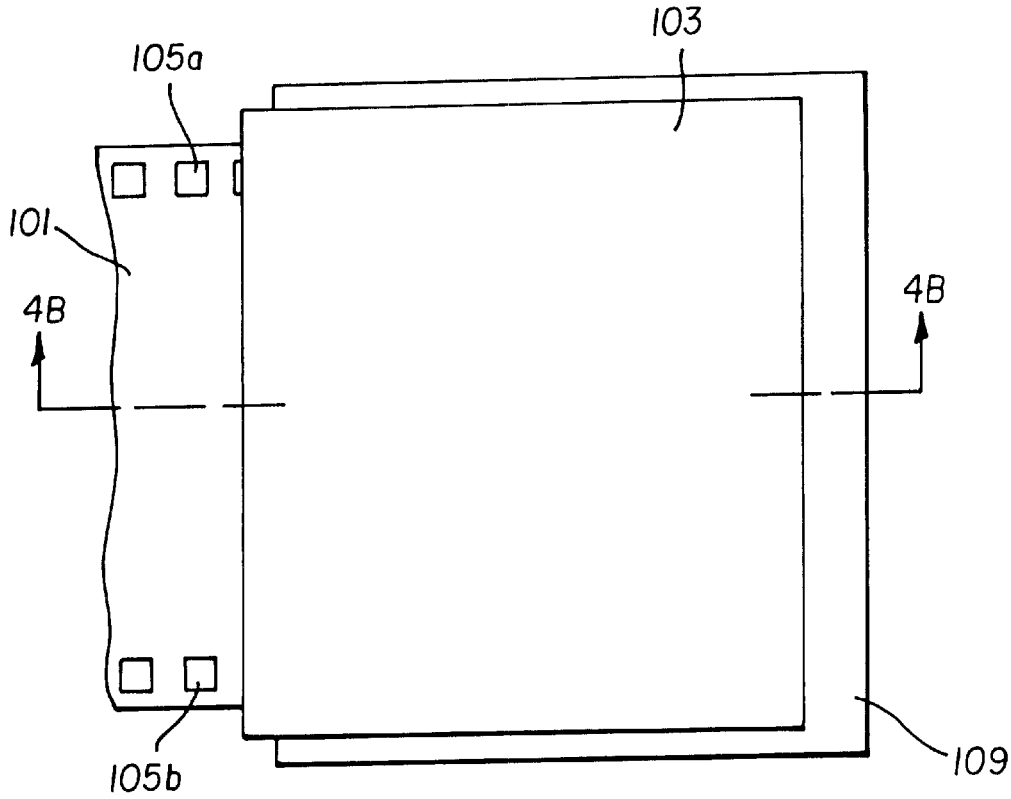
FIG. 4A illustrates a photosensitive film, a laminate processing sheet and an absorbing sheet in accordance with a second embodiment of the present invention.
Figure 4B:
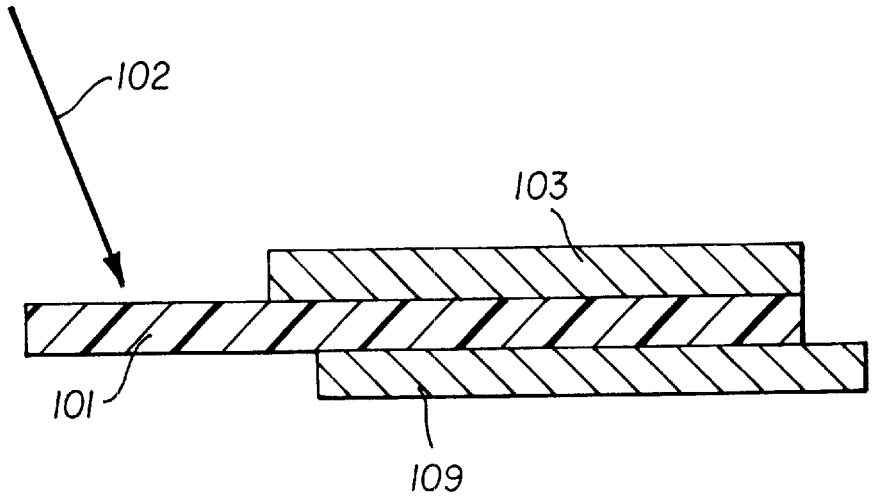
FIG. 4B is a side view of the photosensitive film, laminate processing sheet and absorbing sheet as illustrated in FIG. 4A.

FIGS. 4A–4B illustrate a second embodiment of the present invention. Like FIG.3A, FIG. 4A shows an image-wise exposed camera formatted film 101 having sprocket holes 150*a*, 105*b* with laminate processing sheet 103 applied to the emulsion side. Unlike the embodiment of FIG. 3A, in FIG. 4A laminate processing sheet 103 is not narrowed. In order to address the processing marks, in the embodiment of FIG. 4A an absorbing sheet 109 is applied to the support side of the film 101 which is opposite the emulsion side. FIG. 4B is a side view of the arrangement of FIG. 4A and illustrates the application of a wetting solution to moisten the emulsion face of film 101 in the direction shown by 102. FIG. 4B also shows the intimate contact of laminate processing sheet 103 to the emulsion face of film 101, as well as the intimate contact of absorbing sheet 109 to the backside of film 101.

Absorbing sheet 109 operates to absorb and or wick excess solution at or around sprocket holes 105*a*, 105*b*, and thus is effective to suppress or reduce any unwanted processing marks or comets which can otherwise originate from the sprocket holes to mark the finished image. Image 107 as illustrated in FIG. 5 can also be obtained utilizing the arrangement of FIG. 4A. A known apparatus for applying processing laminates can be modified to apply an absorbent sheet to the backside of the camera film. With respect to the absorbing material, any type or form of absorbing material such as a gel or sheet can be employed. Further, the absorbing material can be supplied or applied onto the film in a one-time use form or as a continuous roll that can be readily regenerated, as for example, by solution evaporation. Further, it is preferable that the absorbing material be strong and resilient to facilitate transport through an apparatus such as shown in FIG. 2.

Figure 6A:
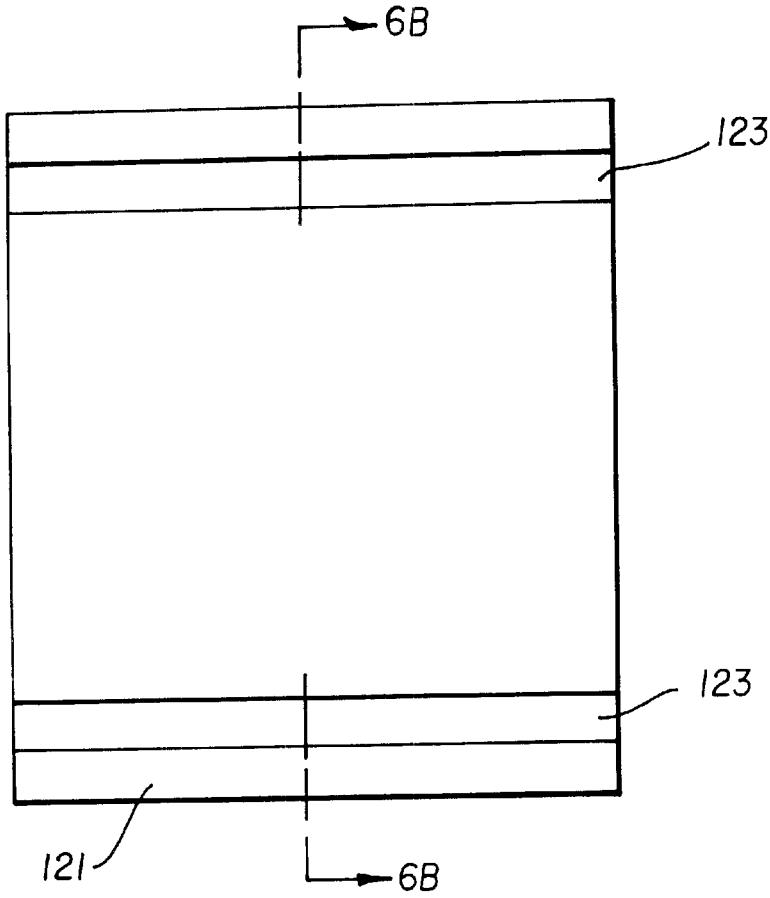
FIG. 6A illustrates a sumping member.
Figure 6B:
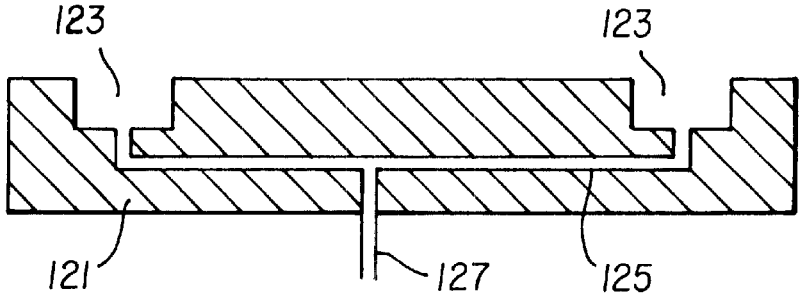
FIG. 6B illustrates an end view of the sumping member of FIG. 6A.

FIG. 6A illustrates a sumping member 121 having a width adequate to support the photographic element during processing which includes channels 123 adapted to align with the sprocket holes of an applied photographic film. FIG. 6B shows a side view of FIG. 6A along line d–d. Channels 123 are connected by draining tube 125 which in turn exits the sumping member through an adapter 127 suitable for draining fluids as they accumulate in channels 123. While drainage can be accomplished by any convenient means, including gravity, it is preferred that a sufficient vacuum be applied to the channels through adapter 127 to actively urge processing solutions from the sprocket holes during processing. The results of this arrangement would be the same as the previously described embodiments in that the processing marks at the sprocket holes or in the vicinity of the sprocket holes would be eliminated.

Figure 7A:
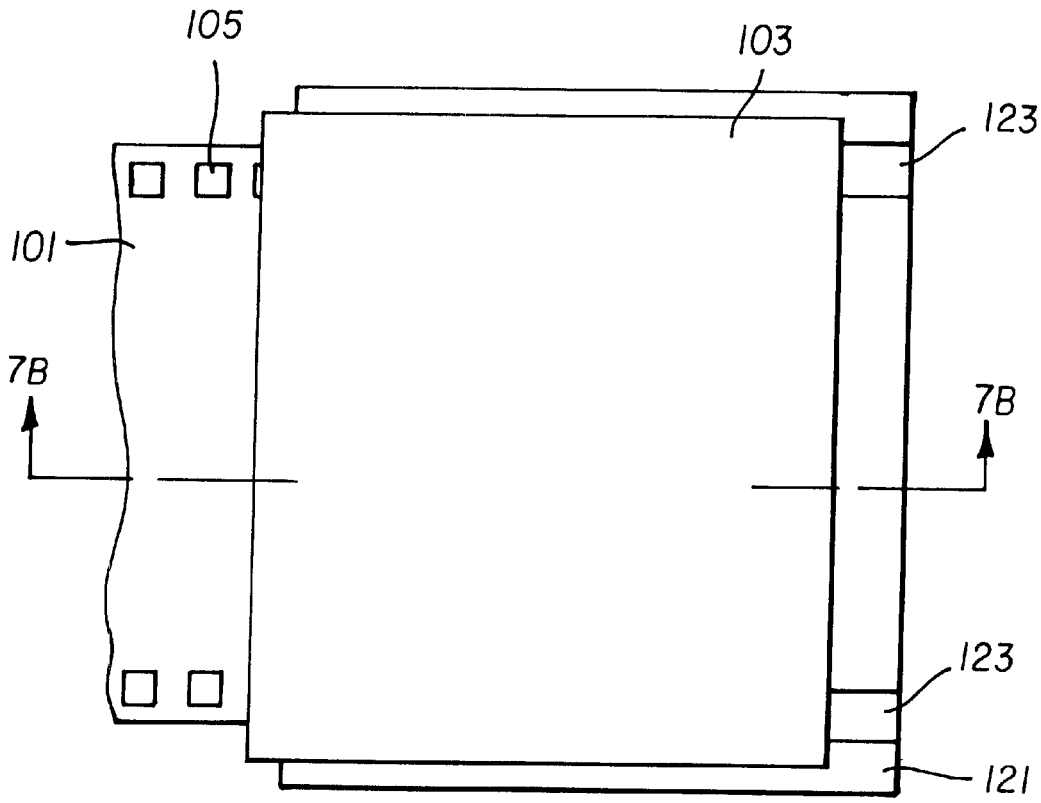
FIG.7A illustrates a photosensitive film, a laminate processing sheet and a sumping member in accordance with a third embodiment of the present invention.
Figure 7B:
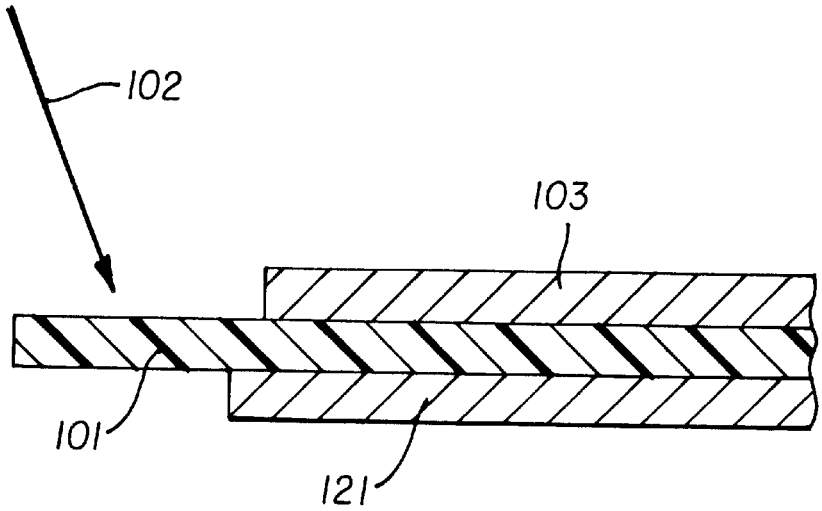
FIG. 7B is a side view of the photosensitive film, laminate processing sheet and sumping member as illustrated in FIG. 7A.

FIG. 7A illustrates the exposed photographic film 101, the laminate sheet 103 and the sumping member 121 with channels 123 aligned to the sprocket holes 105 of the film. FIG. 7B shows an end view of the assembly of FIG. 7A and illustrates the direction of application of moisture. The sumping member can be adapted to be a heating member.

The invention has been described in detail with particular reference to certain preferred embodiments thereof, but it will be understood that variations and modifications can be effected within the spirit and scope of the invention.

What is claimed is:

1. An image forming assembly comprising:

a laminate processing sheet adapted to be laminated on an emulsion side of an exposed photosensitive film, said laminate processing sheet comprising a processing component for processing the photosensitive film, said photosensitive film having first sprocket holes extending longitudinally along a first side edge of the photosensitive film and second sprocket holes extending longitudinally along a second side edge of the photosensitive film, such that a first widthwise distance is defined between said first sprocket holes and said second sprocket holes, said laminate processing sheet defining on said photosensitive film a second widthwise distance which is smaller than said first widthwise distance so as to not extend over said first and second sprocket holes when the laminate processing sheet is laminated over the photosensitive film.

2. An image forming assembly according to claim 1, further comprising:

a moisture applying device adapted to apply wetting solution to the emulsion side of the exposed photosensitive film to moisten the emulsion side of the photosensitive film.

3. An image forming assembly comprising:

a processing sheet adapted to be applied on an emulsion side of an exposed photosensitive film, said processing sheet comprising processing solution for processing said photosensitive film;

wherein said photosensitive film comprises opposing sprocket holes and said processing sheet is applied on a area of said photosensitive film which is between said opposing sprocket holes.

4. An image forming assembly comprising:

a laminate processing sheet adapted to be laminated on an emulsion side of an exposed photosensitive film, said laminate processing sheet comprising a processing component for processing the photosensitive film, said photosensitive film having sprocket holes extending longitudinally along only a first side edge of the photosensitive film, such that a first widthwise distance on said photosensitive film is defined between said sprocket holes and a second side edge of said photosensitive film, said laminate processing sheet defining a second widthwise distance which is smaller than said first widthwise distance so as to not extend over said sprocket holes when the laminate processing sheet is laminated over the photosensitive film.

* * * * *